US006153969A

United States Patent [19]

Levine

[11] Patent Number: 6,153,969

[45] Date of Patent: Nov. 28, 2000

[54] BISTABLE FIELD EMISSION DISPLAY DEVICE USING SECONDARY EMISSION

[75] Inventor: Jules D. Levine, Dallas, Tex.

[73] Assignee: Texas Instruments Incorporated, Dallas, Tex.

[21] Appl. No.: 09/211,210

[22] Filed: Dec. 14, 1998

Related U.S. Application Data

[60] Provisional application No. 60/068,018, Dec. 18, 1997.

[51] Int. Cl.[7] ..... H01J 1/02

[52] U.S. Cl. ..... 313/309; 313/336; 313/351; 313/495

[58] Field of Search ..... 313/309, 310, 313/336, 351, 495

[56] References Cited

U.S. PATENT DOCUMENTS 5,796,211 9/1998 Graebner et al. ..... 313/336

5,814,926 9/1998 Tomihari ..... 313/309

*Primary Examiner*—Vip Patel

*Attorney, Agent, or Firm*—Wade James Brady, III; Frederick J. Telecky, Jr.

[57] ABSTRACT

A field emission display device includes groupings of microtip emitters 14 which are energized by applying a negative potential to cathode 16 relative to the signal electrode 22, thereby inducing an electric field which draws streams of electrons 38 from the apexes of microtips 14. Electrons 38 emitted from microtips 14 impinge upon extraction plate 36 causing emission of a secondary stream of electrons 40 which are accelerated toward anode 40. Apparatus and methods for controlling these primary and secondary electron streams are described.

18 Claims, 3 Drawing Sheets

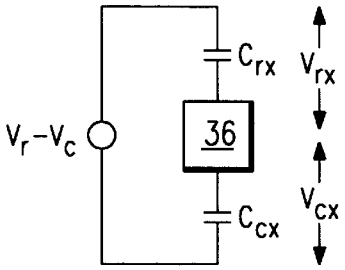
FIG. 4
| | | ROW SIGNAL | |
|---|---|---|---|
| | | OPEN | 220 V |
| COLUMN SIGNAL | 0 V | UNCHANGED | 110 V WHITE |
| | 30 V | UNCHANGED | 95 V BLACK |
| | OPEN | UNCHANGED | UNCHANGED |
FIG. 5
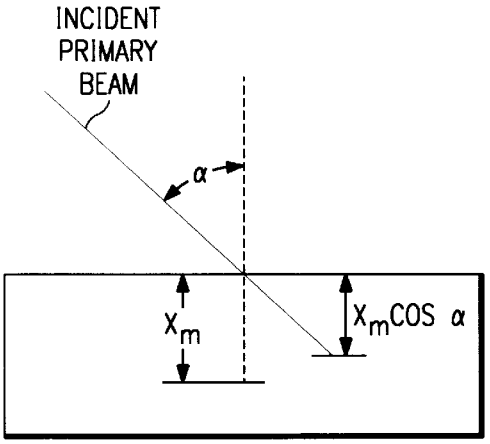
FIG. 6
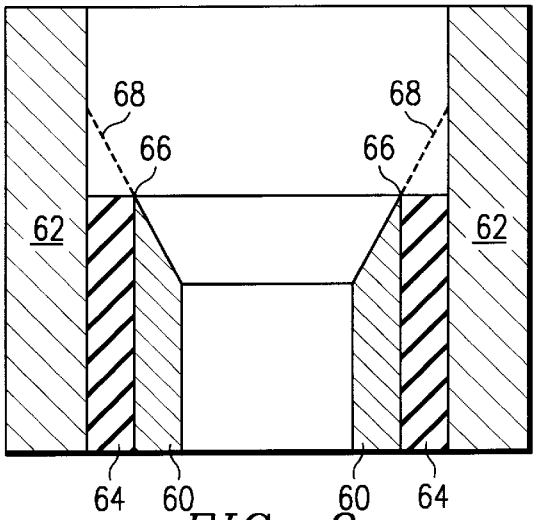
FIG. 8
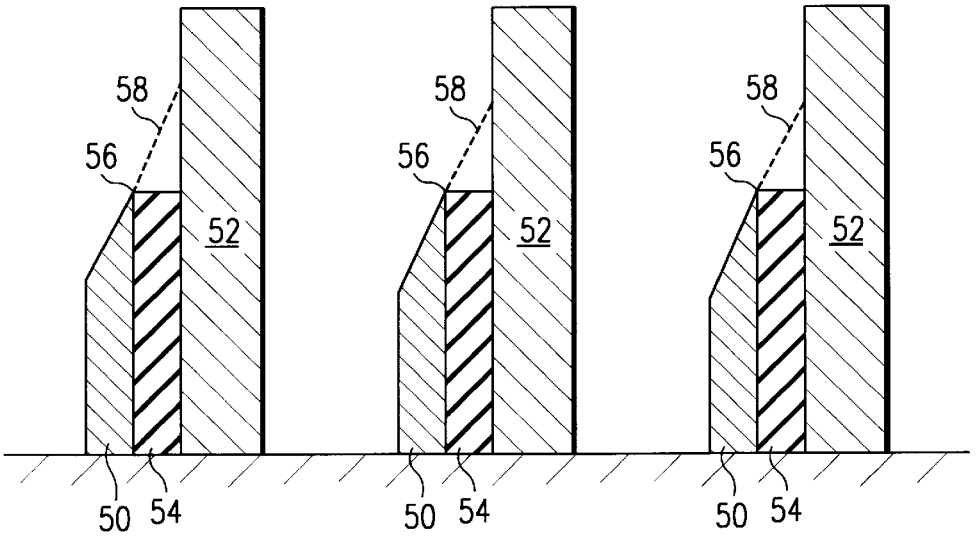
FIG. 7

BISTABLE FIELD EMISSION DISPLAY DEVICE USING SECONDARY EMISSION

This application claims priority under 35 USC § 119(e) (1) of provisional application No. 60/068,018 filed Dec. 18, 1997.

TECHNICAL FIELD OF THE INVENTION

The present invention relates generally to field emission flat panel display devices and, more particularly, to a display device having an emitter structure which includes an extraction plate for providing bimodal secondary electron emission.

BACKGROUND OF THE INVENTION

Advances in field emission display technology are disclosed in U.S. Pat. No. 3,755,704, "Field Emission Cathode Structures and Devices Utilizing Such Structures," issued Aug. 28, 1973, to C. A. Spindtetal.; U.S. Pat. No. 4,940,916, "Electron Source with Micropoint Emissive Cathodes and Display Means by Cathodoluminescence Excited by Field Emission Using Said Source," issued Jul. 10, 1990 to Michel Borel et al.; U.S. Pat. No. 5,194,780, "Electron Source with Microtip Emissive Cathodes," issued Mar. 16, 1993 to Robert Meyer; and U.S. Pat. No. 5,225,820, "Microtip Trichromatic Fluorescent Screen," issued Jul. 6, 1993, to Jean-Frédéric Clerc. These patents are incorporated by reference into the present application.

One of the technical challenges currently facing researchers in the area of field emission display development relates to the tendency of the electron stream emanating from the electron emitters to disperse at an angle on the order of 30°. Such a dispersion spreads the beam impingent on the luminescent coating of the anode over a relatively wide area, resulting in a image display of poor resolution. Many focusing schemes have been proposed to reduce the dispersion of electrons as they traverse the space between the emitter and collector electrodes. See, for example, U.S. Pat. No. 5,070,282, "An Electron Source of the Field Emission Type," issued Dec. 3, 1991, to B. Epsztein, which discloses a negatively biased control electrode, placed downstream of the extracting electrode, causing the electrons to converge toward the axis of the beam. See also U.S. Pat. No. 5,235,244, "Automatically Collimating Electron Beam Producing Arrangement," issued Aug. 10, 1993, to C. A. Spindt, which discloses a passive dielectric electron beam deflector.

A second technical challenge involves the limitations in gray scale definition as the pixel density of the display screen increases. U.S. Pat. No. 4,857,799, issued Aug. 15, 1989, to C. A. Spindt et al., discloses a row-at-a-time scanning display, in which an entire row of pixels is simultaneously energized, rather than energization of individual pixels. According to this scheme, sequential rows are energized to provide a display frame, as opposed to sequential energization of individual pixels in a raster scan manner. This extends the duty cycle for each panel in order to provide enhanced brightness. Nevertheless, as the size of the display screen increases with an concomitant increase in the number of rows, the dwell time at each row decreases, resulting in a decreased number of gray scale gradations.

A third challenge, somewhat related to the problem raised by the gray scale limitation, is the limitation of image brightness in a scanning display, especially one with a large number of rows. Since the scanning feature allows each row of emitters to emit electrons only during the period that row is being addressed, there must be a very high level of emission and high impact energy at the phosphors in order to provide sufficient luminescent energy to persist, either in the phosphors or in the human optic system or in both, until the next scan period.

A fourth challenge involves the relatively large phosphor area required on the display screen of a field emission display device. The duration of electron emission on each phosphor spot is relatively short dwell time afforded by row-at-a-time scanning. In order for sufficient luminescent energy to be maintained until the next scan period, each phosphor spot must be relatively large in area. However, image contrast is enhanced by having a larger black matrix area surrounding each phosphor spot. Thus, for improved contrast, a reduction in the phosphor spot area is desirable.

The present invention addresses the above-described shortcomings of present field emission displays.

SUMMARY OF THE INVENTION

In accordance with the principles of the present invention, there is disclosed herein an electron emission apparatus which comprises an electron emitter for providing primary electron emission, a signal electrode, and source means coupled to the electron emitter and the signal electrode for providing potentials therebetween. The electron emission apparatus further comprises a conductive extraction plate adjacent to and electrically insulated from the electron emitter and the signal electrode. The extraction plate is positioned to intercept substantially all of the electrons of the primary emission and to generate secondary electron emission.

Further in accordance with the principles of the present invention, there is disclosed herein a field emission display apparatus comprising an electron collection structure having an anode electrode and having a region of an electroluminescent material overlying the anode electrode. The field emission display apparatus also comprises an emitter structure including an electron emitter for providing primary electron emission, a signal electrode, first source means coupled to the electron emitter and the signal electrode for providing potentials therebetween, and a conductive extraction plate adjacent to and electrically insulated from the electron emitter and the signal electrode. The extraction plate is positioned to intercept the primary electron emission and is capable of being charged in accordance with the potential of the first source means.

A first level of charge on the extraction plate which is sufficient to convert the primary emission of electrons intercepted from the electron emitter into secondary emission which is greater than the primary emission causes the extraction plate to charge positively to a first stable voltage state. The field emission display apparatus further comprises second source means coupled to the anode electrode for applying an electron accelerating potential thereto. The electron collection structure is positioned to collect electrons of the secondary emission at the region of electroluminescent material overlying the anode electrode.

A second level of charge on the extraction plate which is sufficient to convert the primary emission of electrons intercepted from the electron emitter into secondary emission which is less than the primary emission causes the extraction plate to charge negatively to a second stable voltage state, wherein no electrons pass to the anode electrode.

While the extraction plate is charged to the first stable voltage state, the primary and secondary electron emissions persist until a change in the potential of the first source means causes the extraction plate to charge negatively to the second stable voltage state.

The present invention provides significant benefits which relate directly to the aforementioned challenges of persistence and contrast. Unlike traditional scanning schemes which allow each row of emitters to emit electrons only during the period that row is being addressed, a bimodal display device in accordance with the present invention provides, for each pixel selected for illumination, a continuous stream of electrons onto its corresponding phosphor spot and, therefore, a brighter overall display. As a result of this constant form of illumination, each phosphor spot may be reduced in area, permitting a larger black matrix region, and thus improving contrast. Furthermore, since each pixel state persists until it is affirmatively changed, constant line-at-time scanning is obviated, and each row need only be addressed if a pixel in that row must be altered. This provides the opportunity for increased bandwidth, leading to enhanced gray scale gradations.

BRIEF DESCRIPTION OF THE DRAWING

The foregoing features of the present invention may be more fully understood from the following detailed description, read in conjunction with the accompanying drawings, wherein:

FIG. 4 depicts a simplified version of the FIG. 3 circuit for a rapidly varying signal pulse;

FIG. 5 is a truth table demonstrating the bimodal states of the display device fabricated according to the present invention;

FIG. 6 illustrates how a shallow angle of incidence can reduce the voltage of the first crossover;

FIG. 7 is a cross-sectional view of a portion of a field emission device fabricated according to a second embodiment of the present invention;

FIG. 8 is a cross-sectional view of a portion of a field emission device fabricated according to a third embodiment of the present invention;

DESCRIPTION OF THE PREFERRED EMBODIMENT

Figure 1:
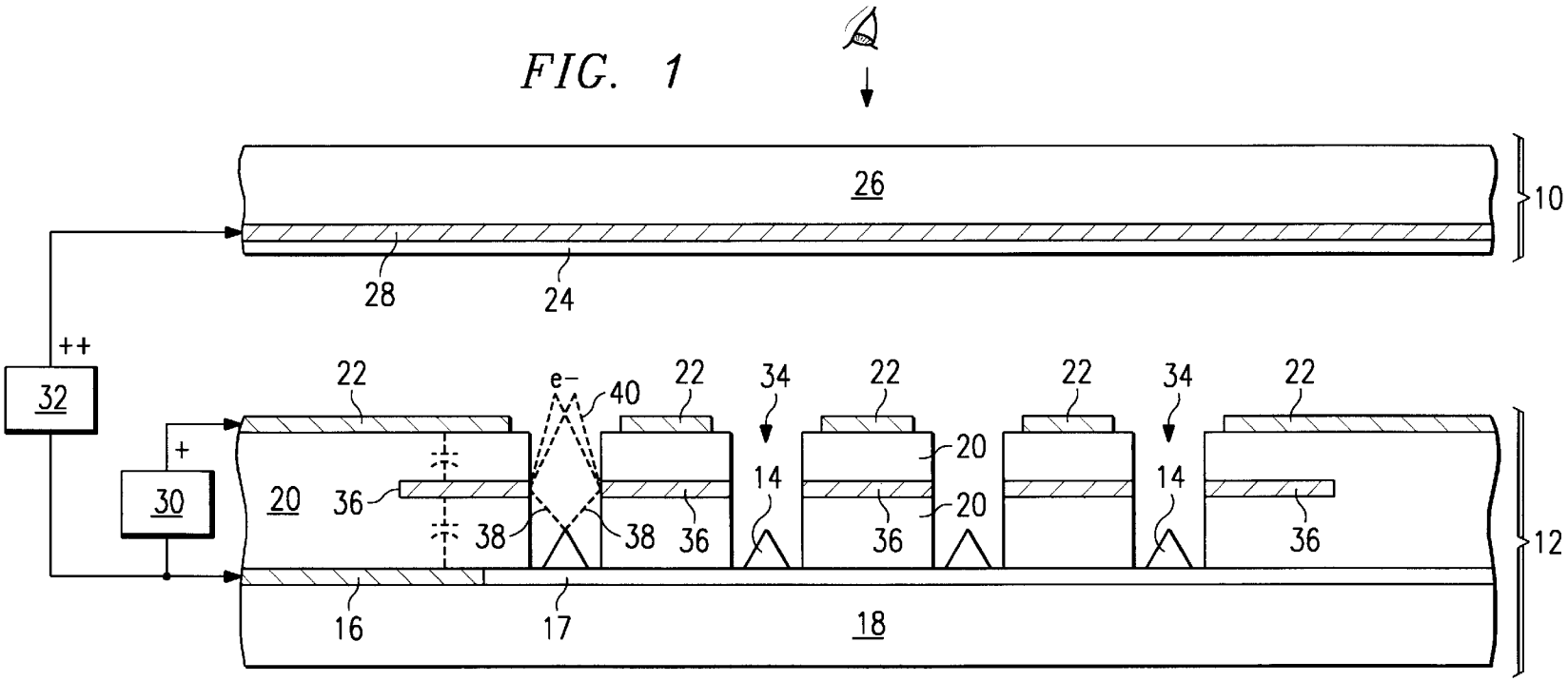
FIG. 1 is a cross-sectional view of a portion of a field emission display device fabricated according to the present invention.

Referring initially to FIG. 1, there is shown, in cross-sectional view, a portion of an illustrative field emission device which includes an extraction plate for providing bimodal secondary electron emission in accordance with the present invention. In this embodiment, a field emission flat panel display device comprises an anode portion having an electroluminescent phosphor coating facing a cathode portion, the phosphor coating being observed from the side opposite to its excitation.

More specifically, the field emission display device of FIG. 1 comprises a cathodoluminescent anode structure 10 and an emitter, or cathode, structure 12. Cathode structure 12 comprises a plurality of electrically conductive microtips 14 formed on an electrically conductive coating 17, which is itself formed on an electrically insulating substrate 18. Coating 17 may be semiconducting or resistive instead of being conducting; in a preferred embodiment, microtips 14 are formed on a resistive amorphous silicon layer which is coupled to a conductive layer 16 functioning as the cathode electrode. Substrate 18 is illustratively soda-lime glass.

An extraction plate 36 comprises a layer of an electrically conductive material which is formed within insulating layer 20. A signal electrode 22 comprises a coating of an electrically conductive material which is deposited on top of insulating layer 20. Microtips 14 take the shape of cones which are formed within apertures 34 through conductive layer 22, extraction plate 36 and insulating layer 20. Signal electrode 22 is recessed away from apertures 34 so as to avoid communication with the primary stream 38 of electrons emitted from microtips 14 and the secondary stream 40 of electrons emitted from extraction plate 36. The conductive coating which forms signal electrode 22 may be in the form of a continuous coating across the surface of substrate 18; alternatively, it may comprise conductive bands across the surface of substrate 18. Conductive coating 22 forms a substantially planar surface on cathode structure 12.

Anode structure 10 comprises an electrically conductive film 28 deposited on a transparent planar support 26 which is positioned facing signal electrode 22 and parallel thereto, the conductive film 28 being deposited on the surface of support 26 directly facing signal electrode 22. Conductive film 28 may be in the form of a continuous coating across the surface of support 26 as shown in FIG. 1; alternatively, it may be in the form of electrically isolated stripes comprising three series of parallel conductive bands across the surface of support 26, as taught in U.S. Pat. No. 5,225,820, to Clerc. By way of example, a suitable material for use as conductive film 28 may be indium-tin-oxide (ITO), which is optically transparent and electrically conductive.

Anode structure 10 also comprises a cathodoluminescent phosphor coating 24, deposited over conductive film 28 so as to be directly facing and immediately adjacent signal electrode 22. Phosphor coating 24 forms a substantially planar surface on anode structure 10. In the Clerc patent, the conductive bands of each series are covered with a phosphor coating which luminesces in one of the three primary colors, red, blue and green.

Anode 10 and cathode 12 are maintained at a fixed distance from one another by a plurality of spacers (not shown) which may typically comprise glass columnar members distributed across the active region of the display. Anode structure 10 and cathode structure 12 are sealed together at peripheral portions thereof by a sealing material (not shown), illustratively comprising a glass frit rod.

In accordance with the present invention, all or selected groupings of microtip emitters 14 of the above-described structure are energized by applying a negative potential to conductor 16, functioning as the cathode electrode, relative to the signal electrode 22, via voltage source 30, thereby inducing an electric field which draws streams of electrons 38 from the apexes of microtips 14. Electrons 38 emitted from microtips 14 impinge upon extraction plate 36 causing emission of a secondary stream of electrons 40. The present invention relates to the control of these electron streams 38 and 40, and these matters are described and explained more fully in succeeding paragraphs and particularly in conjunction with FIGS. 2 through 6.

The emitted electrons are accelerated toward the anode plate 10 which is positively biased by the application of a substantially larger positive voltage from voltage source 32 coupled to conductive film 28 functioning as the anode electrode. Energy from the electrons attracted to the anode conductive film 28 is transferred to particles of the phosphor coating 24, resulting in luminescence. The electron charge is transferred from phosphor coating 24 to conductive film 28, completing the electrical circuit to voltage source 32.

Because the electrons of the secondary stream 40 are liberated from extraction plate 36 with essentially zero energy and, therefore, very little lateral movement, the accelerating potential on anode electrode 28 draws electrons 40 directly upward. This helps to overcome the aforementioned technical challenge relating to the dispersion of the electron stream, thereby improving the beam focus and aiding in the image resolution.

Figure 2:
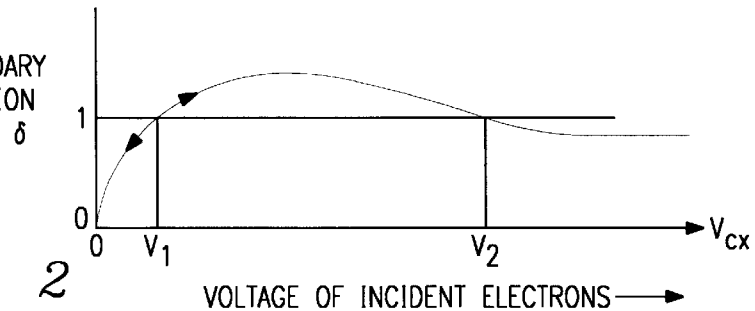
FIG. 2 depicts a generalized graph of secondary emission vs. voltage which is useful in an understanding of the present invention.

FIG. 2 depicts a graph which is useful in an understanding of the present invention. This graph illustrates the secondary emission ratio of a given material as a function of the voltage of the incident electrons, i.e., the kinetic energy of the impingent electrons. Note specifically that as the voltage increases, the secondary emission ratio increases to a value of one at a first crossover point $V_1$ and then eventually decreases back down to a ratio of one at a second crossover point $V_2$. What this means is that below the first crossover point $V_1$, that is below a certain voltage difference between the two conductors, more electrons are being added to the surface being bombarded than are actually emitted therefrom by means of secondary emission. Therefore, such a surface would continue to charge negatively until the voltage difference reaches the level where the first crossover point $V_1$ is passed, at which time the surface begins to charge to a more positive potential due to the loss of more electrons from the surface than are actually captured. Thus, the material making up extraction plate 36 should be selected to display a secondary emission ratio below its first crossover point $V_1$ at the particular operating voltage of cathode electrode 16.

Figure 3:
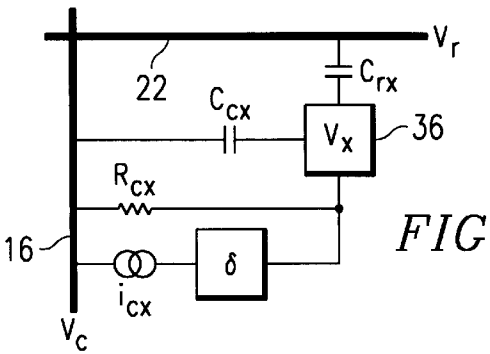
FIG. 3 depicts an equivalent circuit of the arrangement of the electron emission display device shown diagrammatically in FIG. 1.
Figure 11A:
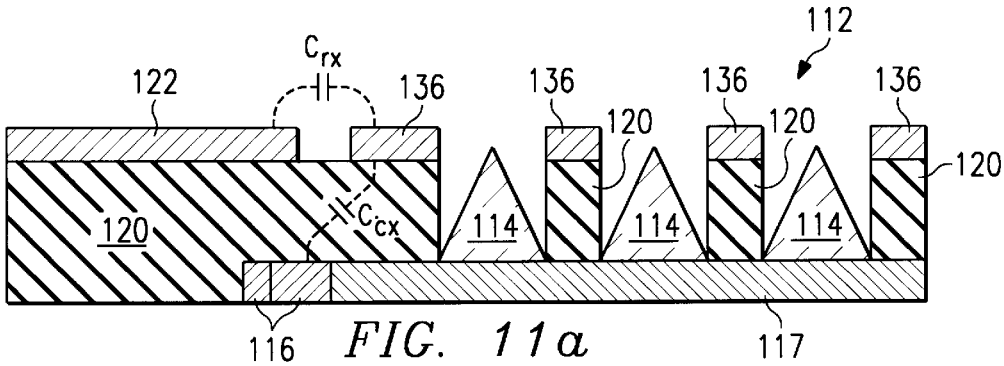
FIGS. 11*a* and 11*b* illustrate in section and plan views, respectively, a crossover arrangement of the row and column conductors so as to minimize capacitive coupling therebetween.
Figure 11B:
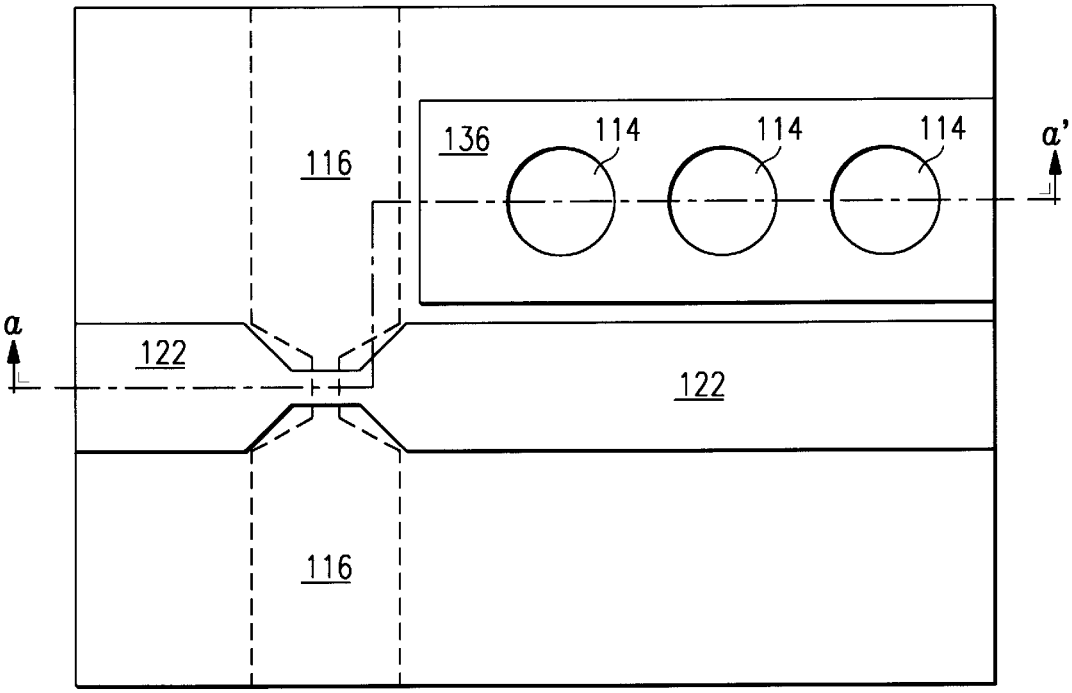

Accordingly, FIG. 3 depicts an equivalent circuit of the arrangement of the electron emission shown diagrammatically in FIG. 1. In this circuit, $V_r$ represents the time varying potential applied to the row (signal) electrode 22 and $V_c$ represents the time varying potential applied to the column (cathode) electrode 16. Extraction plate 36 is capacitively coupled to row and column electrodes 22, 16 by capacitances $C_{rx}$ and $C_{cx}$, respectively, resulting in a voltage $V_x$ on extraction plate 36 which is intermediate $V_c$ and $V_r$. Current source $I_{cx}$ arises from the field emission of electrons from microtip emitter 14 (coupled to cathode electrode 16 as shown in FIG. 1) and is dependent on the potential difference between $V_c$ and $V_x$. Voltage $V_x$ is controlled by circuit element δ, the secondary emission coefficient, which is dependent on the difference between $V_c$ and $V_x$. One will observe that due to the inevitable physical crossover of row and column lines, there will be a direct capacitance term $C_{rc}$ between the row and column. This capacitance is not shown in the circuit of FIG. 3, since it is designed to be considerably smaller than the indirect capacitance terms $C_{rx}$ and $C_{cx}$. One way of implementing the minimal crossover between a row and column is shown in the embodiment of FIGS. 11*a* and 11*b*, to be discussed in greater detail in a succeeding paragraph.

Although the circuit diagram of FIG. 3 appears to be complex, it is in reality the combination of two circuit diagrams. One circuit diagram, corresponding to a rapidly varying potential between the row and column conductors 22, 16, as in a pulse which results from the coincidence of an addressing signal on the row line and a data signal on the column line, is shown in FIG. 3. For such rapidly varying signal pulse, the current across capacitances $C_{rx}$ and $C_{cx}$ is large, and the previous charge information which had been stored in these capacitances is overwhelmed.

Under the limiting case of pulse conditions, the potential of extraction plate 36 is just that which would be expected from a capacitive divider circuit shown in FIG. 4, and the potentials are related by $$V_{xc}/(V_r-V_c)=C_{rx}/(C_{rx+Cx}),$$

which for the present example of equal capacitances $C_{rx}$ and $C_{cx}$, $$V_{xc}/(V_r-V_c)=½.$$

After the pulsed potential is fixed on extraction plate 36, its time evolution follows the sampled portion of the beam that hits the sidewalls and the secondary emission at the surfaces. If the coefficient δ>1, and if these secondary emissions are collected by an electrode at a higher potential, e.g., anode electrode 28 (as shown in FIG. 1), then the potential on extraction plate 36 will rise and achieve stability at a level between the first and second crossovers, depending on the leakage through resistance $R_{cx}$ and subject to a sufficiently long sampling period. If, on the other hand, the coefficient δ<1, then the potential on extraction plate 36 will drop and achieve stability at a level below the first crossover, again depending on the leakage through resistance $R_{cx}$ and subject to a sufficiently long sampling period.

Referring now to FIG. 5, there is shown a voltage truth table demonstrating the bimodal states of a display device fabricated according to the present invention. For the purposes of this example, it will be assumed that the capacitors $C_{rx}$ and $C_{cx}$ of the divider circuit shown in FIG. 3 (or FIG. 4) are of equal capacitance. This means that under pulsing conditions, the value of extraction plate 36 will be equal to half the voltage difference between capacitors $C_{rx}$ and $C_{cx}$. Also in this example, it will be assumed that the material of extraction plate 36 is characterized by a first crossover voltage of 100 volts. Further assume that the "relaxed" state of the pixel illuminated by the emitter or emitters at the intersection of the particular row and column under investigation is the on state or white pixel.

The voltage levels used in this example correspond to an assumed first crossover voltage level of 100 V. It will also be assumed that all of the pixels are white (illuminated, i.e., electron emission causing luminescence of the anode plate phosphors) and that one or more of these pixels must be transformed to black (no luminescence, i.e., no electron emission;) by line-at-a-time scanning.

The row signal generating procedure is as follows: for an addressed row, the potential is 220 V; for an unaddressed row, the row potential is allowed to float, shown as "OPEN" in the truth table. These values are displayed across the top of the truth table.

The column signal generating procedure is as follows: the default value of the column signal is 0 V and, during a pulse of the column signal, the value goes to 30 V. The two potentials 0 V and 30 V are shown at the left of the truth table of FIG. 5. The third possibility is for the column to be floating, which is called "OPEN" in the truth table.

The are four cases to consider with regard to the states (pixel content) of the truth table of FIG. 5. First, consider the case for one unaddressed row with floating potential (OPEN). No matter what the value of the potential on the column, there is no change in pixel content. This is shown by the three boxes in the Row Signal="OPEN" column of the truth table.

The second case involves one addressed row with 220 V potential and 0 V on the column. Since the row-to-column difference is 220 V, the capacitor divider produces at the extractor plate a potential of 110 V, which is greater than the 100 V crossover voltage level. This means that time evolution will generate a white pixel, and the corresponding box in the truth table is marked accordingly.

The third case involves one addressed row with 220 V potential and 30 V on the column. Since the row-to-column difference is 190 V, the capacitor divider produces at the extractor plate a potential of 95 V, which is less than the 100 V crossover voltage level. This means that time evolution will generate a black pixel, and the corresponding box in the truth table is marked accordingly.

Finally, consider the case of one addressed row with 220 V potential and a floating (OPEN) column. There is no change to the pixel of interest. This is shown by the box in the lower right of the truth table.

A significant benefit of the present system which is revealed by this voltage truth table relates directly to the aforementioned challenges of persistence and contrast. Unlike traditional scanning schemes which allow each row of emitters to emit electrons only during the period that row is being addressed, a bimodal display device in accordance with the present invention provides, for each pixel selected for illumination, a continuous stream of electrons onto its corresponding phosphor spot and, therefore, a brighter overall display. As a result of this constant form of illumination, each phosphor spot may be reduced in area, permitting a larger black matrix region, and thus improving contrast. Furthermore, since each pixel state persists until it is affirmatively changed, constant line-at-time scanning is obviated, and each row need only be addressed if a pixel in that row must be altered. This provides the opportunity for increased bandwidth, leading to enhanced gray scale gradations.

FIG. 6 illustrates how a shallow angle of incidence can reduce the voltage of the first crossover required to produce secondary emission. It is known, for example, that the secondary emission curve for niobium, the preferred material for extraction plate 36 (FIG. 1), has a first crossover at 200 V. However, there is a substantial lowering of this voltage when the primary electrons approach the electrode at an angle $\alpha$ to the normal. FIG. 6 illustrates that if $X_m$ is the mean penetration depth of a normal primary electron, then for a primary electron impingent at an angle $\alpha$ to the normal, this penetration depth now becomes reduced to $X_m$*cos $\alpha$.

Theory and data on secondary emission support the observation that the secondary emission curve ($\delta$ versus V) scales on the voltage coordinate with the function sqrt (cos $\alpha$). For example, suppose that an electron is glancingly incident on a niobium surface such that $\alpha$=70°, cos $\alpha$=0.34 and sqrt (0.34)=0.58. Given that the first crossover for a normally incident primary electron is 200 V, the first crossover for a 70° incident primary electron is calculated to be 200 V*0.58=116 V. The magnitude of this voltage is sufficiently low for practical applications. As an example, considering the simple capacitor divider circuit of FIG. 4 having equal capacitor elements, the switching voltage required is about 2*116 V=232 V.

Referring now to FIG. 7, there is shown a cross-sectional view of a portion of a field emission device fabricated according to a second embodiment of the present invention, wherein the injection angle of the primary electrons is precisely controlled for secondary emission at reduced voltage. This device includes linear emitters 50 each separated from a corresponding linear floating electrode (extraction plate) 52 by a linear insulating material 54. Emitters 50 are tapered toward their emitting tips 56 so that the primary electron emission 58 is directed onto electrodes 52 at a glancing angle.

Referring now to FIG. 8, there is shown a cross-sectional view of a portion of a field emission device fabricated according to a third embodiment of the present invention. As is true for the embodiment of FIG. 7, this third embodiment ensures that the injection angle of the primary electrons is precisely controlled for secondary emission at reduced voltage. This device includes ring-shaped emitter 60 separated from a ring-shaped floating electrode (extraction plate) 62 by a ring-shaped insulating material 64. Ring-shaped emitter 60 is tapered toward its emitting edge 66 so that the primary electron emission 68 is directed onto ring-shaped electrode 62 at a glancing angle.

It is generally known that the secondary emission characteristic shows an instability at the first crossover voltage $V_1$ where $\delta$=1 (See FIG. 2). For $V>V_1$, the voltage will spontaneously rise. What is needed is a shunt resistor of known resistance $R_{shunt}$ which defines the steady state voltage between the cathode electrode and extractor plate by the relation $$V_{cx}=(i_{secondary}-i_{primary})*R_{shunt},$$

where $V_{cx}$ is the voltage on the extractor plate.

Figure 9:
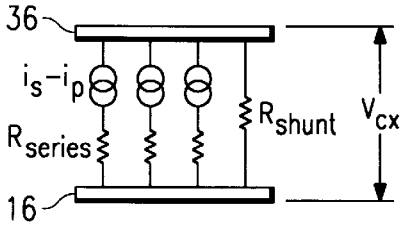
FIG. 9 depicts a secondary emission circuit providing enhanced stability.

To obtain uniformity of pixel brightness it is necessary that $R_{shunt}$ be uniform. Generally, this can be difficult, but in the field emission display device of FIG. 1, there is a resistive layer 17 in series with each microtip 14, whose purpose is to make the cathode emission uniform. The are a multiplicity of microtips 14 for each pixel. FIG. 9 depicts an equivalent circuit of a pixel, illustratively showing three microtips in the pixel. The current sources $i_s$–$i_p$ represent the microtips 14, the resistances $R_{series}$ represent the resistance of layer 17 between each microtip 14 and the cathode electrode 16, and $R_{shunt}$ represents the shunt resistance between cathode electrode 16 and extraction plate 36.

In an illustrative embodiment, the desired voltage drop across each series resistor (the amorphus silicon layer) is about 10 V, which provides a 10% buffer for the desired potential between cathode electrode 16 and extractor plate 36 of about 100 V. The desired voltage drop across the shunt resistor shown in this example is the cathode-extractor voltage $V_{cx}$, which is about 100 V. Therefore, $R_{shunt}$ must be about 10 times greater than the $R_{series}$.

Figure 10:
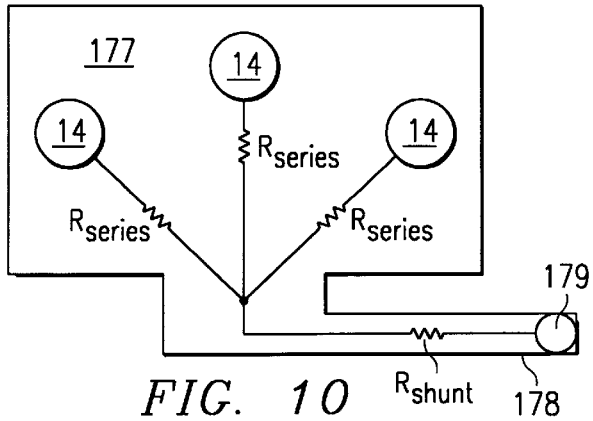
FIG. 10 is a plan view of a layout incorporating the circuit of FIG. 9.

Referring now to FIG. 10, there is shown a plan view of a circuit arrangement which provides $R_{shunt}$ from the FIG. 9 circuit in the field emission display device of FIG. 1. FIG. 10 illustrates an improved configuration 177 for resistive layer 17 (of FIG. 1) for a pixel (or subpixel) of three microtips 14. Layer 177, illustratively made of amorphous silicon, includes a narrow (and therefore high resistance) region 178, which comprises $R_{shunt}$. Via 179 provides electrical coupling between the end of region 178 remote from microtips 14 and extractor plate 36 (FIG. 1). This configuration assures the desired pixel uniformity of a white screen by taking advantage of the resistive layer already in place, requiring little extra cost.

FIG. 11*b* is a plan view and FIG. 11*a* is a sectional view through section line a–a' of a crossover arrangement of row and column conductors so as to minimize capacitive coupling therebetween. In this arrangement, a cathode structure 112 comprises a plurality of electrically conductive microtips 114 formed on a layer 117, which is preferably resistive, e.g., amorphous silicon. A control, or extraction, electrode 136 comprises a layer of an electrically conductive material which is formed on insulating layer 120. Column electrode 116 comprises a stripe of an electrically conductive material formed under insulating layer 120 and in electrical contact with layer 117. Row electrode 122 comprises a stripe of an electrically conductive material formed on top of insulating layer 120.

In this arrangement, capacitance $C_{rx}$ is formed by the lateral gap between row electrode 122 and the control electrode 136, and capacitance $C_{cx}$ is formed by the vertical gap between column electrode 116 and control electrode 136. The capacitances formed by these gaps can be selected by adjusting the relative positions of these electrodes. The "necking-down" of the row electrode 122 and column electrode 116 at their crossover area minimizes the capacitance between them.

A field emission flat panel display device, as disclosed herein, including means for generating a stream of secondary emission electrons, overcomes limitations and disadvantages of the prior art display devices and methods. First, a bimodal display device in accordance with the present invention provides, for each pixel selected for illumination, a continuous stream of electrons onto its corresponding phosphor spot and, therefore, a brighter overall display. Furthermore, as a result of this constant form of illumination, each phosphor spot may be reduced in area, permitting a larger black matrix region, and thus improving contrast. Finally, since each pixel state persists until it is affirmatively changed, constant line-at-time scanning is obviated, and each row need only be addressed if a pixel in that row must be altered. This provides the opportunity for increased bandwidth, leading to enhanced gray scale gradations. Hence, for the application to flat panel display devices envisioned herein, the approaches in accordance with the present invention provide significant advantages.

While the principles of the present invention have been demonstrated with particular regard to the structures and methods disclosed herein, it will be recognized that various departures may be undertaken in the practice of the invention. The scope of the invention is not intended to be limited to the particular structures and methods disclosed herein, but should instead be gauged by the breadth of the claims which follow.

What is claimed is:

1. Electron emission apparatus comprising:

an electron emitter for providing primary electron emission;

a signal electrode;

source means coupled to said electron emitter and said signal electrode for providing potentials therebetween; and a conductive extraction plate adjacent to and electrically insulated from said electron emitter and said signal electrode, said extraction plate positioned to intercept substantially all electrons of said primary emission and generate secondary electron emission.

2. The electron emission apparatus in accordance with claim 1 wherein said extraction plate is positioned between said electron emitter and said signal electrode.

3. The electron emission apparatus in accordance with claim 2 wherein said electron emitter, said signal electrode, and said conductive extraction plate are formed as concentric cylindrical members.

4. The electron emission apparatus in accordance with claim 1 wherein said electron emitter is electrically coupled to a cathode electrode, and wherein said cathode electrode and said signal electrode are formed in intersecting relationship but spaced from one another by an insulating layer, and wherein said extraction plate is formed coplanar with one of said cathode electrode and said signal electrode and laterally spaced therefrom, said extraction electrode being spaced from the other of said cathode electrode and said signal electrode at least by said insulating layer.

5. The electron emission apparatus in accordance with claim 1 further including a cathode electrode, said electron apparatus being formed as a multilayer structure comprising said cathode electrode as a bottom layer, said extraction plate as an intermediate layer electrically insulated from said cathode layer, and said signal electrode as a top layer electrically insulated from said extraction plate; and wherein said electron emitter comprises a microtip in electrical communication with said cathode electrode in an aperture formed through said signal electrode and said extraction plate.

6. Electron emission apparatus comprising:

an electron collection structure having an anode electrode; and an emitter structure including an electron emitter for providing primary electron emission, a signal electrode, source means coupled to said electron emitter and said signal electrode for providing potentials therebetween, and a conductive extraction plate adjacent to and electrically insulated from said electron emitter and said signal electrode, said extraction plate positioned to intercept substantially all electrons emitted by said electron emitter;

said electron collection structure positioned to collect electrons from said emitter structure at said anode electrode.

7. The electron emission apparatus in accordance with claim 6 wherein said extraction plate is capable of being charged to a level determined by the potential of said first source means, a first level of charge on said extraction plate being sufficient to convert said primary emission of electrons intercepted from said electron emitter into secondary emission which is greater than said primary emission, said emissions causing said extraction plate to charge positively to a first stable voltage state.

8. The electron emission apparatus in accordance with claim 7 wherein said extraction plate is capable of being charged to a level determined by the potential of said first source means, a second level of charge on said extraction plate being sufficient to convert said primary emission of electrons intercepted from said electron emitter into secondary emission which is less than said primary emission, said emissions causing said extraction plate to charge negatively to a second stable voltage state.

9. The electron emission apparatus in accordance with claim 6 wherein said electron emitter and said extraction plate are coupled by a first capacitance, and said signal electrode and said extraction plate are coupled by a second capacitance, said first and second capacitances being such that said extraction plate charges, in response to a potential of said first source means, to a voltage which is approximately one-half of said first source means potential.

10. The electron emission apparatus in accordance with claim 6 wherein said extraction plate is positioned with respect to said electron emitter such as to intercept said electrons at an oblique angle to an intercepting surface of said extraction plate.

11. The electron emission apparatus in accordance with claim 6 wherein said extraction plate is positioned with respect to said electron emitter such as to intercept said electrons at a grazing angle to an intercepting surface of said extraction plate.

12. The electron emission apparatus in accordance with claim 6 further including second source means coupled to said anode electrode for applying an electron accelerating potential thereto.

13. Field emission display apparatus, comprising:

an electron collection structure having an anode electrode and having a region of an electroluminescent material overlying said anode electrode;

an emitter structure including an electron emitter for providing primary electron emission, a signal electrode, first source means coupled to said electron emitter and said signal electrode for providing potentials therebetween, and a conductive extraction plate adjacent to and electrically insulated from said electron emitter and said signal electrode, said extraction plate positioned to intercept said primary electron emission, said extraction plate being capable of being charged in accordance with the potential of said first source means, wherein a first level of charge on said extraction plate sufficient to convert said primary emission of electrons intercepted from said electron emitter into secondary emission which is greater than said primary emission causes said extraction plate to charge positively to a first stable voltage state; and second source means coupled to said anode electrode for applying an electron accelerating potential thereto;

said electron collection structure positioned to collect electrons of said secondary emission at said region of electroluminescent material overlying said anode electrode.

14. The field emission display apparatus in accordance with claim 13 wherein a second level of charge on said extraction plate sufficient to convert said primary emission of electrons intercepted from said electron emitter into secondary emission which is less than said primary emission causes said extraction plate to charge negatively to a second stable voltage state.

15. The field emission display apparatus in accordance with claim 13 wherein said electron emitter and said extraction plate are coupled by a first capacitance, and said signal electrode and said extraction plate are coupled by a second capacitance, said first and second capacitances being such that said extraction plate charges, in response to a potential of said first source means, to a voltage which is approximately one-half of said first source means potential.

16. The field emission display apparatus in accordance with claim 13 wherein said extraction plate is positioned with respect to said electron emitter such as to intercept said electrons at an oblique angle to an intercepting surface of said extraction plate.

17. The field emission display apparatus in accordance with claim 13 wherein said extraction plate is positioned with respect to said electron emitter such as to intercept said electrons at a grazing angle to an intercepting surface of said extraction plate.

18. The field emission display apparatus in accordance with claim 14 wherein, while said extraction plate is charged to said first stable voltage state, said primary and secondary electron emissions persist until a change in the potential of said first source means causes said extraction plate to charge negatively to said second stable voltage state.

* * * * *